US010066370B2

(12) United States Patent
Faivre et al.

(10) Patent No.: US 10,066,370 B2
(45) Date of Patent: Sep. 4, 2018

(54) SENSOR FUSION FOR IMPLEMENT POSITION ESTIMATION AND CONTROL

(71) Applicant: Caterpillar Inc., Peoria, IL (US)

(72) Inventors: Joseph L. Faivre, Edelstein, IL (US); Bradley P. Krone, Dunlap, IL (US); Steven R. Krause, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 375 days.

(21) Appl. No.: 14/886,992

(22) Filed: Oct. 19, 2015

(65) Prior Publication Data

US 2017/0107700 A1 Apr. 20, 2017

(51) Int. Cl.
*E02F 9/26* (2006.01)
*E02F 3/84* (2006.01)
*E02F 9/20* (2006.01)

(52) U.S. Cl.
CPC ..... *E02F 9/265* (2013.01); *E02F 3/845* (2013.01); *E02F 3/847* (2013.01); *E02F 9/2029* (2013.01)

(58) Field of Classification Search
CPC ..... E02F 29/264; E02F 9/265; E02F 3/845; E02F 3/847
See application file for complete search history.

(56) References Cited

U.S. PATENT DOCUMENTS 5,467,829 A * 11/1995 Barton ..... E02F 3/432 172/4.5
5,964,298 A * 10/1999 Greenspun ..... E02F 3/842 172/4.5
6,129,155 A * 10/2000 Lombardi ..... E02F 3/845 172/2
6,282,453 B1 * 8/2001 Lombardi ..... E02F 3/844 700/63
7,588,088 B2 9/2009 Zachman
8,145,391 B2 * 3/2012 Omelchenko ..... E02F 3/842 172/4.5
8,311,710 B2 * 11/2012 Budde ..... E02F 9/265 701/50
8,352,132 B2 * 1/2013 Omelchenko ..... E02F 3/842 172/4.5
8,386,133 B2 * 2/2013 Sahlin ..... E02F 3/847 37/414
8,406,963 B2 * 3/2013 Farmer ..... E02F 3/845 172/10
8,437,926 B2 * 5/2013 Shintani ..... E02F 3/844 172/4.5
8,463,512 B2 6/2013 Hayashi et al.
8,620,534 B2 * 12/2013 Jessen ..... E02F 3/434 414/694
8,700,273 B2 * 4/2014 Farmer ..... E02F 3/845 172/10
8,762,010 B2 * 6/2014 Farmer ..... E02F 3/845 172/10
8,843,279 B2 9/2014 Tafazoli Bilandi et al.
8,977,441 B2 * 3/2015 Grimes ..... E02F 3/96 111/118

(Continued)

*Primary Examiner* — Peter D Nolan
(74) *Attorney, Agent, or Firm* — Miller, Matthias & Hull

(57) ABSTRACT

A controller uses a Kalman filter to develop an estimated position of an implement based on a previous implement position, an implement pitch, an implement pitch rate and an estimated implement linkage velocity. The controller moves the implement to a desired position based on the estimated position of the implement.

19 Claims, 8 Drawing Sheets

(56) References Cited

U.S. PATENT DOCUMENTS

| | | | | |
|---|---|---|---|---|
| 8,977,445 | B2 | 3/2015 | Buettner | |
| 9,222,237 | B1 * | 12/2015 | Green | E02F 9/265 |
| 9,347,205 | B2 * | 5/2016 | Kosarev | G05D 1/0891 |
| 2009/0069987 | A1 * | 3/2009 | Omelchenko | E02F 3/842 701/50 |
| 2010/0023228 | A1 * | 1/2010 | Montgomery | E02F 3/845 701/50 |
| 2011/0046857 | A1 * | 2/2011 | Farmer | E02F 3/845 701/50 |
| 2012/0130601 | A1 | 5/2012 | Paroma et al. | |
| 2012/0130602 | A1 * | 5/2012 | Omelchenko | E02F 3/842 701/50 |
| 2012/0201640 | A1 | 8/2012 | Jessen et al. | |
| 2013/0158818 | A1 * | 6/2013 | Callaway | E02F 3/845 701/50 |
| 2013/0158819 | A1 * | 6/2013 | Callaway | E02F 3/845 701/50 |
| 2013/0161033 | A1 * | 6/2013 | Farmer | E02F 3/845 172/2 |
| 2013/0317707 | A1 * | 11/2013 | Farmer | E02F 3/845 701/50 |
| 2014/0107896 | A1 | 4/2014 | Fehr | |
| 2014/0168009 | A1 | 6/2014 | Peak | |
| 2014/0172246 | A1 | 6/2014 | Farmer et al. | |
| 2016/0122969 | A1 * | 5/2016 | Noborio | G01S 19/49 701/50 |
| 2016/0230366 | A1 * | 8/2016 | Hendron | E02F 3/844 |
| 2017/0101762 | A1 * | 4/2017 | Chaston | E02F 3/844 |
| 2017/0114528 | A1 * | 4/2017 | Kosarev | E02F 9/265 |

* cited by examiner

SENSOR FUSION FOR IMPLEMENT POSITION ESTIMATION AND CONTROL

TECHNICAL FIELD

The present disclosure is generally directed to a work machine and, more particularly, to operation of a hydraulic accessory of a work machine.

BACKGROUND

Large machines, such as dozers, scrapers, excavators, etc., use implements to perform various work functions. Accurately positioning an implement, for example, the depth of a ripper or blade, may be important to the accurate preparation of a worksite for subsequent activity, including mining or construction. Cylinder position sensors using magnetostrictive technology can give accurate measurements of implement position but can be expensive and may require each cylinder rod to be gun bored so that wiring and magnetic sensors can be mounted inside. In addition to the cost, these sensors can be difficult to calibrate and maintain in a construction or excavation environment. An inertial measurement unit (IMU) can give a relatively accurate position in an ideal environment but are susceptible to noise when used with heavy equipment. Some implements, such as a dozer blade on arms, do not swing a large enough arc to use a rotary sensor for accurate measurements of arm angle.

With respect to implement position sensors, U.S. Pat. No. 8,620,534, issued Dec. 31, 2013 to Jessen (the '534 patent), discloses sensing the position of an implement by first developing a static position using an inclination sensor and subsequently using an estimated cylinder travel to arrive at an estimated new position. However, the '534 patent fails to account for other movement of the machine or inaccuracies associated with cylinder position estimation.

SUMMARY OF THE DISCLOSURE

In an aspect of the disclosure, a method of positioning an implement of a machine includes determining a desired implement position and developing an estimated implement linkage velocity based on an evaluation of a hydraulic circuit coupled to the implement. The method also includes determining an estimated implement pitch using an inertial measurement unit (IMU) coupled to the implement as well as determining an estimated implement pitch rate using the IMU. The method continues by combining the estimated implement linkage velocity, the estimated implement pitch, and the estimated implement pitch rate using a weighted formula to develop an estimated implement position. The implement is then moved to the desired implement position based on the estimated implement position.

In another aspect of the disclosure, a system for positioning an implement includes an implement moveably attached to a chassis of the machine, a hydraulic circuit configured to supply pressurized hydraulic fluid, and a hydraulic cylinder that moves the implement relative to the chassis via hydraulic fluid flow in the hydraulic circuit. The system also includes a sensor configured to generate data corresponding to the hydraulic fluid flow in the hydraulic circuit. The system further includes an implement inertial measurement unit (IMU) that generates implement position information about a position of the implement relative to gravity and a chassis IMU that provides machine position information about a position of the chassis machine relative to gravity. The system further includes a controller configured to control a position of the implement relative to the chassis based on an estimated position of the implement relative to the chassis. The estimated position of the implement relative to the chassis is calculated using a weighted combination of the hydraulic fluid flow, the implement position information from the implement IMU, and the machine position information from the chassis IMU.

In yet another aspect of the disclosure, a method of positioning an implement in a machine comprises developing, using a controller using a Kalman filter, an estimated position of the implement based on a previous implement position, an implement pitch, an implement pitch rate, and an estimated implement linkage velocity. The method concludes by moving the implement, using the controller, to a desired position based on the estimated position of the implement.

These and other aspects and features will be more readily understood when reading the following detailed description and taken in conjunction with the accompanying drawings.

DETAILED DESCRIPTION

Figure 1:
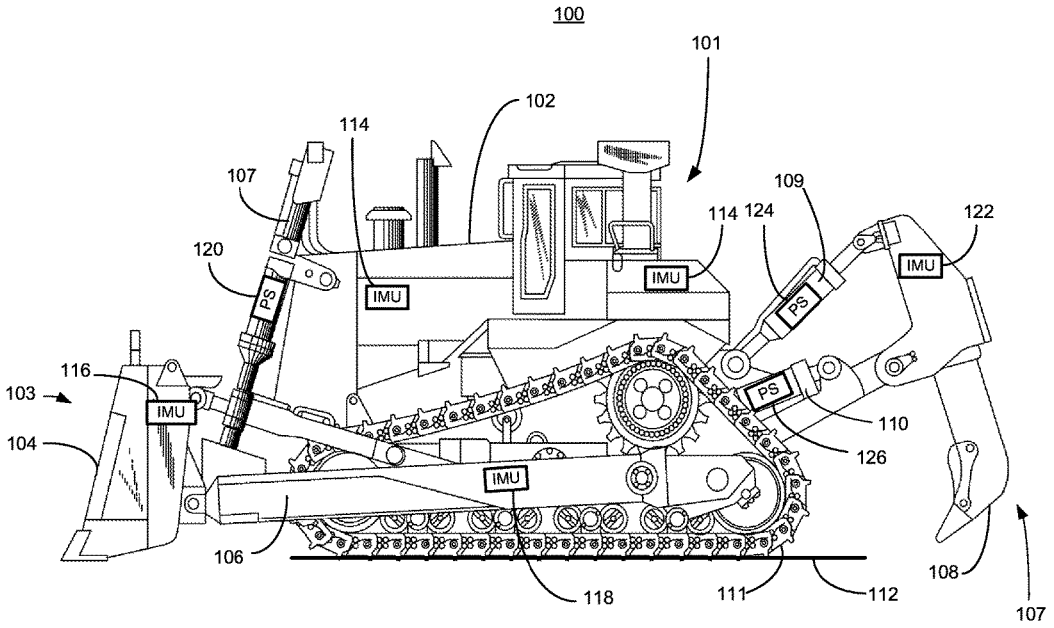
FIG. 1 is a side view of a machine in accordance with the current disclosure.

Referring to FIG. 1, a machine 100 such as a dozer 101 is used to illustrate an exemplary embodiment of sensor fusion for implement position estimation. Of course, the machine 100 can be presented in the form of many other earth-moving work machines including but not limited to excavators, motor graders, pipelayers, loaders, pavers, harvesters, mining trucks, and the like. The dozer 101 includes a chassis 102 and an implement 103. One embodiment of the implement 103 is a blade 104. The blade 104 is coupled to an arm 106 which is raised and lowered via a cylinder 107. The dozer 101 may also have another implement, a ripper 108. The ripper 108 is operated by an upper cylinder 109 and a lower cylinder 110. The dozer 101 has tracks 111 that engage a work surface 112 to propel the dozer 101.

Inertial measurement units (IMUs) are devices that report acceleration in one or more dimensions or degrees of freedom. A time derivative of acceleration data can used to provide velocity and position information. Since gravity represents a constant acceleration toward a center of the earth, any fore-to-aft pitch or side-to-side tilt is detectable, particularly when the machine 100, such as the dozer 101, is stationary. In addition, acceleration caused by a change in velocity is detectable at an IMU. However, during operation an IMU can generate noise due to centripetal or tangential accelerations such as non-zero machine pitch and yaw rates. In an embodiment, one or more chassis IMUs 114 may be mounted on the chassis 102 of the dozer 101 to provide information about the current position of the chassis 102 with respect to gravity.

In addition to the one or more chassis IMUs 114, a blade IMU 116 may be mounted on the blade 104 and an arm IMU 118 may be mounted on the arm 106. A ripper IMU 122 may be mounted on the ripper 108. Pressure sensors may be used as part of a process to determine cylinder travel. Once cylinder travel is determined, movement of the implement 103 can then be determined. A pressure sensor 120 may sense cylinder pressure at the cylinder 107 associated with movement of the arm 106. Pressure sensors 124 and 126 may sense cylinder pressure in the upper cylinder 109 and the lower cylinder 110, respectively. The upper cylinder 109 moves the ripper 108 fore and aft relative to the chassis 102. The lower cylinder 110 moves the ripper 108 up and down relative to the work surface 112. The use of cylinder pressure with other data to determine implement motion is discussed more below.

Figure 2:
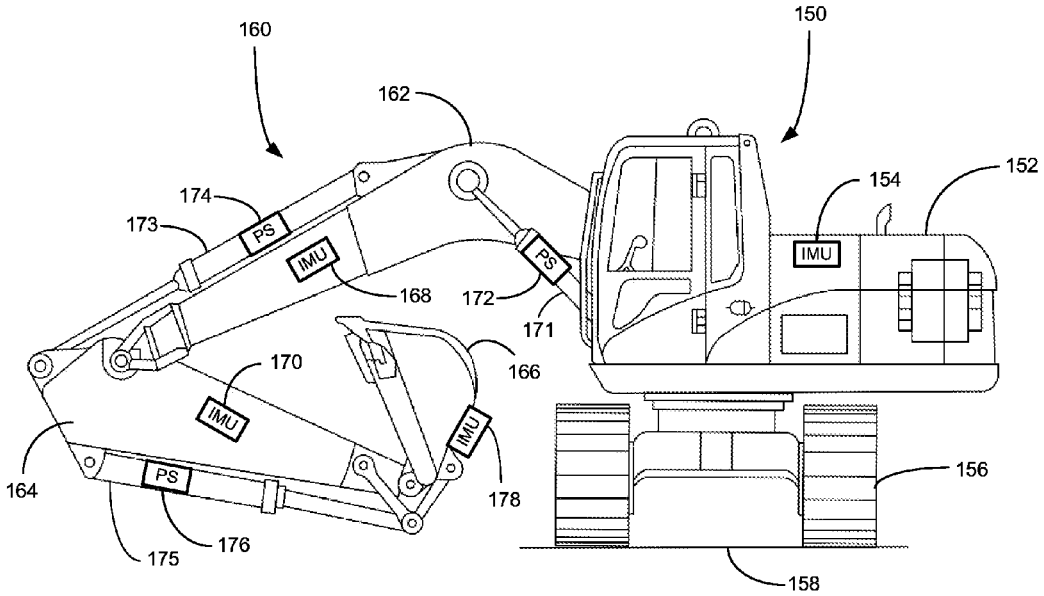
FIG. 2 is an end view of another machine in accordance with the current disclosure.

An excavator 150 is illustrated in FIG. 2. The excavator 150 is another exemplary machine that may be used to illustrate sensor fusion for implement position estimation. The excavator 150 includes a chassis 152 and a chassis IMU 154. The excavator 150 moves on tracks 156 over a work surface 158. The excavator 150 also includes an implement 160 made up of a boom 162, a stick 164, and a bucket 166. A boom IMU 168 reports position of the boom 162 relative to gravity. Pressure in a boom cylinder 171 is measured by a boom cylinder pressure sensor 172. Position of the stick 164 is measured by a stick IMU 170 and pressure in a stick cylinder 173 is measured by a stick cylinder pressure sensor 174. Pressure in a bucket cylinder 175 is measured by a bucket cylinder pressure sensor 176. In some embodiments, a bucket IMU 178 may be used, but the bucket 166 is subjected to many external forces and is not always conducive to use of the bucket IMU 178.

Figure 3:
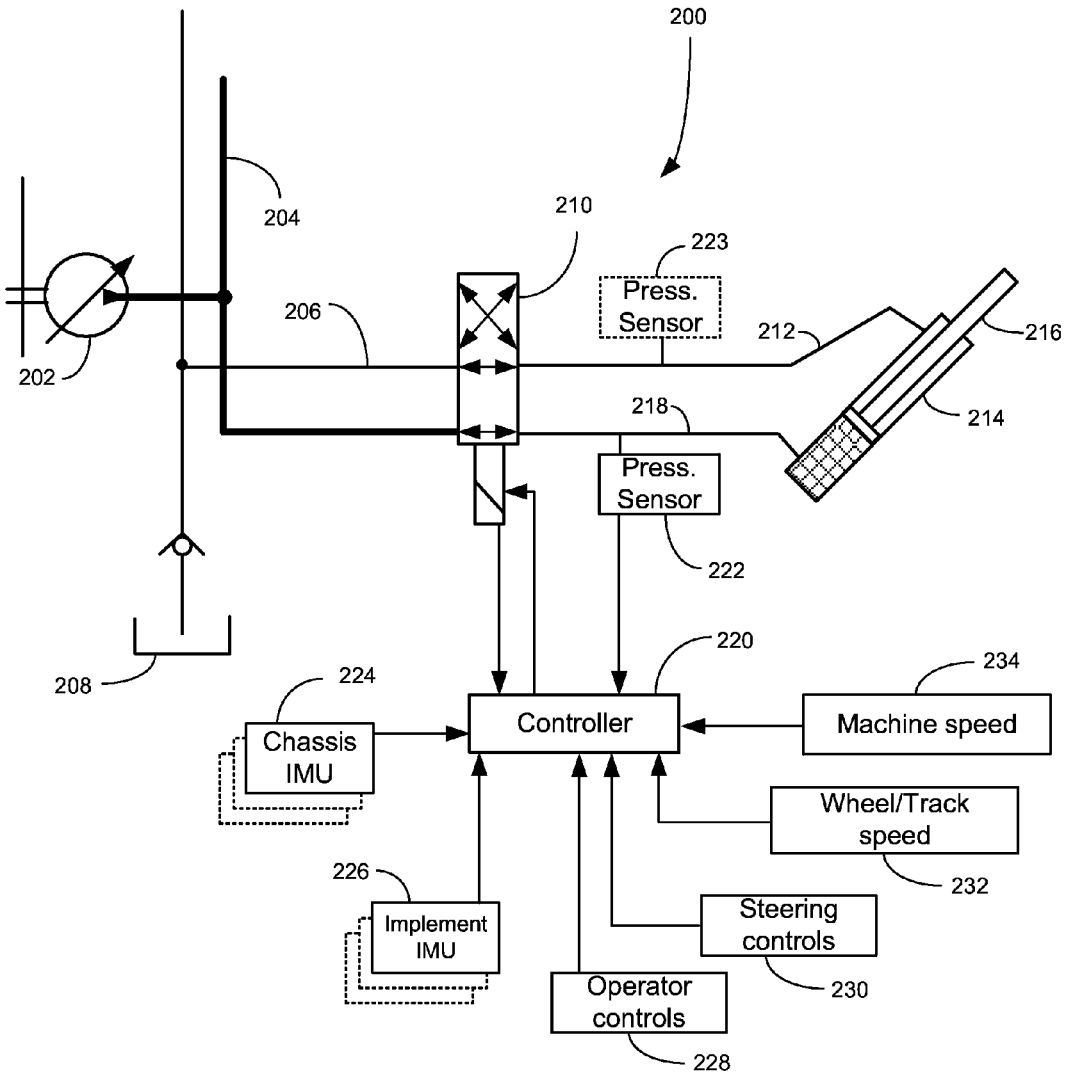
FIG. 3 is a schematic illustration of exemplary elements in a machine used for implement position estimation and implement control.

FIG. 3 illustrates exemplary elements for use in implement position estimation using sensor fusion. A hydraulic circuit 200 is used to drive a hydraulic cylinder 214, such as the cylinder 107 of FIG. 1. The hydraulic circuit 200 includes a hydraulic pump 202 and a high pressure line 204 coupled to a hydraulic valve 210. In an embodiment, the hydraulic valve 210 may be an electrohydraulic valve. The high pressure line 204 may be connected to either a head-end line 218 or a rod-end line 212 of the hydraulic cylinder 214 based on the position of the hydraulic valve 210. A rod 216 is either retracted or extended based on a fluid flow into a first end or a second end of the hydraulic cylinder 214. Return flow is directed via a return line 206 to a tank 208.

A controller 220 is used to develop position estimations for the implement 103 and to control related movement of the implement 103. The controller 220 may be a standalone microprocessor-based unit with integral memory and input and output circuits. In another embodiment, the controller 220 may be an engine controller or body controller that incorporates other control tasks as well as implement-related control. A pressure sensor 222 monitors pressure in the head-end line 218 and an optional pressure sensor 223 monitors pressure in the rod-end line 212. The controller 220 receives data from the pressure sensor 222 and optional pressure sensor 223 to aid in determining implement activity.

The controller 220 may also receive information from a chassis IMU 224. The chassis IMU 224 may be one of several IMU sensors mounted to the chassis 102 of the machine 100 such as the one or more chassis IMUs 114 of FIG. 1 and the chassis IMU 154 of FIG. 2. An implement IMU 226 may be one of several implement IMUs discussed above with respect to FIGS. 1 and 2, such as the blade IMU 116 and the boom IMU 168. Operator controls 228 are used to control movement of a machine's implements. For example, implements can comprise the blade 104 or the ripper 108. Information from the operator controls 228 as to the state of individual controls may be monitored at the controller 220 and used for weighting input values. Steering controls 230, such as a joystick (not depicted), are used by an operator to cause the dozer 101, the excavator 150, or other machine to move forward and backward and to change direction. As with the operator controls 228, steering control settings may be used by the controller 220 when estimating position of the implement 103. A speed sensor 232 may report wheel or track speed or actual speed over the ground using any of a number of known techniques including engine speed and transmission settings or direct measurement using a GPS receiver. Machine speed, in addition to operator and steering control positions, can be used to estimate machine motion. Machine motion is a weighting factor in the calculations used to estimate implement position, as discussed in more detail below.

INDUSTRIAL APPLICABILITY

In general, the present disclosure can find industrial applicability in work machines in a number of different settings, such as, but not limited to those used in the earth-moving, construction, mining, agriculture, transportation, and forestry industries.

When attempting to determine implement position, IMU data is generally accurate but can be highly noisy, particularly in this working environment. Implement velocity estimation using hydraulic circuit information is not subject to noise but can be inaccurate due to cumulative estimation errors. A Kalman filter lends itself to producing an accurate position estimation based on noisy and inaccurate data. In general, a Kalman filter works in a two-step process. The first step is a prediction step that produces an estimate of the current state of a variable and its uncertainty. In the second step, measurement information including measurement inaccuracy and noise is used to update the estimated state using a weighted average of the measurement information. Noise may include both the ability to extract an accurate signal reading (signal-to-noise level) as well as the ability of the sensor to provide an accurate input (precision). The weighting is adjustable in real time based on the presumed accuracy of the various inputs. As will be developed below, the use of a Kalman filter may be beneficial when estimating implement position using these noisy and/or variously accurate inputs.

Figure 4:
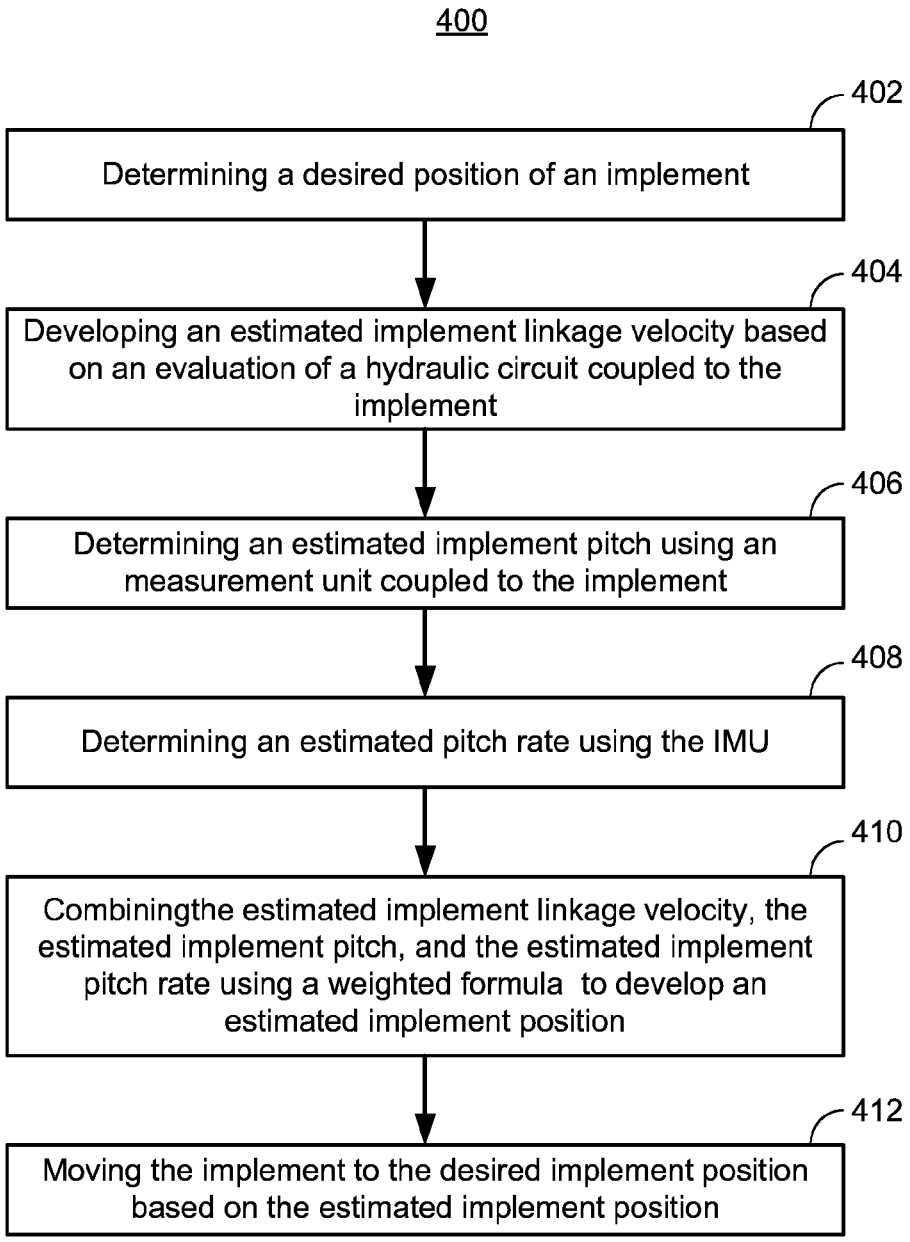
FIG. 4 is a flowchart illustrating one method of performing implement position estimation and implement control.

FIG. 4 is a flowchart 400 of an exemplary method of positioning the implement 103 of the machine 100. At a block 402, a desired implement position is determined. For example, the dozer 101 configured for autonomous operation may have a prescribed track and profile for a particular run that requires the implement 103 such as the blade 104 to operate at a certain depth. At block 404 an estimated implement linkage velocity may be estimated based on a model of linkage mechanics and an evaluation of the hydraulic circuit 200 coupled to the implement 103. That is, by observing fluid flow at the cylinder 107 and knowing the characteristics of both the cylinder 107 and a linkage such as the arm 106, the velocity of the blade 104 can be estimated.

At block 406 an estimated implement pitch may be determined using data from the blade IMU 116 coupled to the blade 104. Using the data from the blade IMU 116, an estimated implement pitch rate may be determined at block 408.

The estimated implement linkage velocity, the estimated implement pitch, and the estimated implement pitch rate may be combined using a weighted formula to develop an estimated implement position at block 410. In an embodiment, a Kalman filter may be used to weight the estimated implement linkage velocity, the estimated implement pitch and the estimated implement pitch rate in view of noise and other factors such as hydraulic activity, steering commands, chassis pitch, etc. The use of the Kalman filter allows real time weighting of these factors in view of known conditions such as noise and inaccuracy of measurements in different conditions. For example, IMU data is more accurate when the machine and implement are at rest, so the IMU data is more highly weighted during that condition.

At block 412, the blade 104 may be moved to the desired implement position based on the estimated implement position. That is, once the current position is estimated, it is relatively straightforward adjust the blade 104 to the desired position by making the necessary changes to the hydraulic circuit 200.

Figure 5:
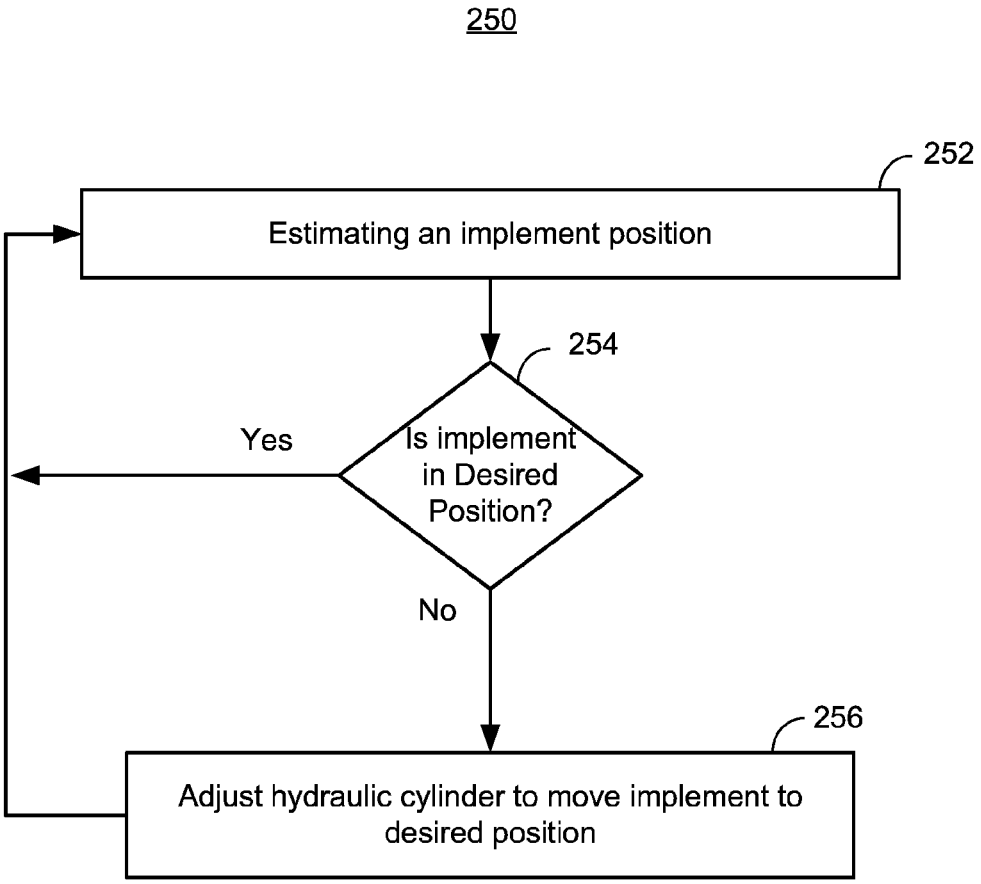
FIG. 5 is a flowchart illustrating another exemplary method of performing implement position estimation and implement control.

A flowchart 250 of a method for combining sensor inputs for implement position estimation and control is shown in FIG. 5. For the purpose of illustration and without limitation, the flowchart 250 will be discussed with respect to the dozer 101 and the blade 104. The concepts discussed are applicable to a broad range of machines with movable implements, including but not limited to, the dozer 101 with the ripper 108 and the excavator 150 with the implement 160. At block 252, an estimated position of the blade 104 relative to the chassis 102 may be made. Additional discussion of details of block 252 follow below.

A determination may be made at block 254 if an implement, such as the blade 104, is in a desired position based on the current position estimate and a desired outcome for operations at a current worksite. If the blade 104 is in the desired position, the 'yes' branch may be taken from block 254 back to block 252. In an embodiment, this loop may execute at an interval of 20 milliseconds. If, at block 254, the blade 104 is not in the desired position, the 'no' branch may be taken to block 256. Desired blade position may be a function of a work plan for a worksite, such as a blade load or a desired cut depth for a particular pass through a track.

At block 256, based on the desired position and knowledge of the implement mechanics, the cylinder 107 may be adjusted to move the blade 104 to the desired position. For example, if the blade 104 is too high, the cylinder 107 may be extended to lower the blade 104. After the adjustment to the blade 104, the process continues again at block 252. When the position of the chassis 102 is known and the implement 103 position relative to the chassis 102 is known, the position of the implement 103 relative to the work surface 112 can also be calculated when of interest for a current work plan.

Figure 6:
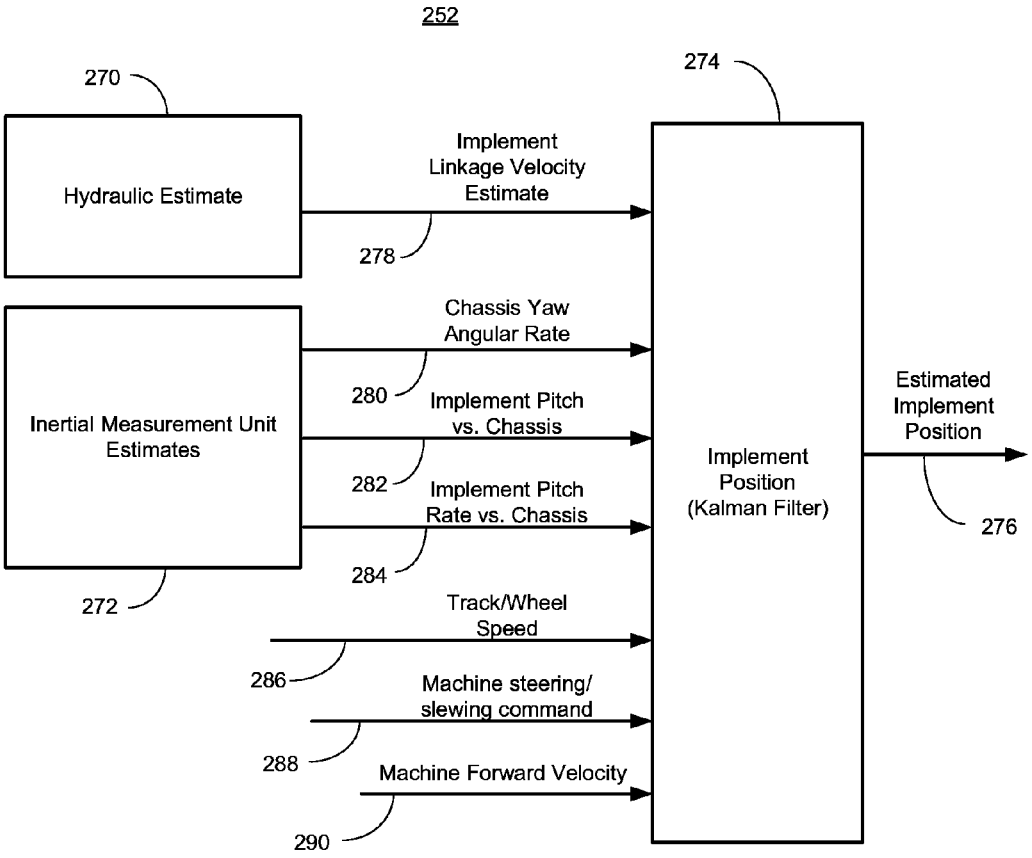
FIG. 6 is a diagram in more detail an aspect of performing implement position estimation.
Figure 7:
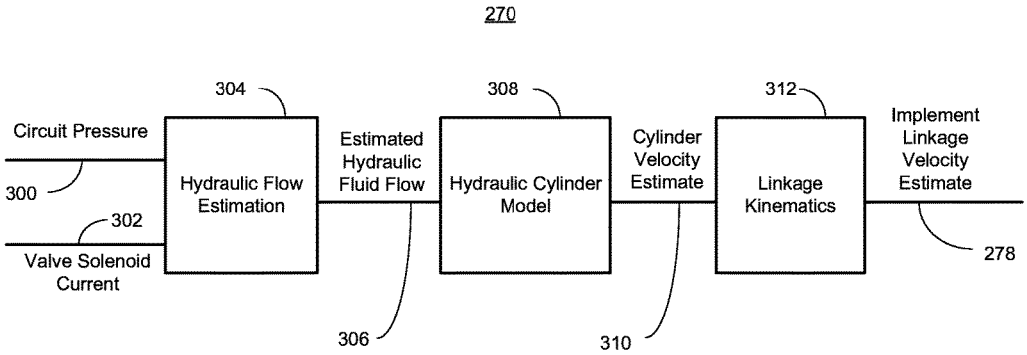
FIG. 7 is an additional diagram further aspects of performing implement position estimation.
Figure 8:
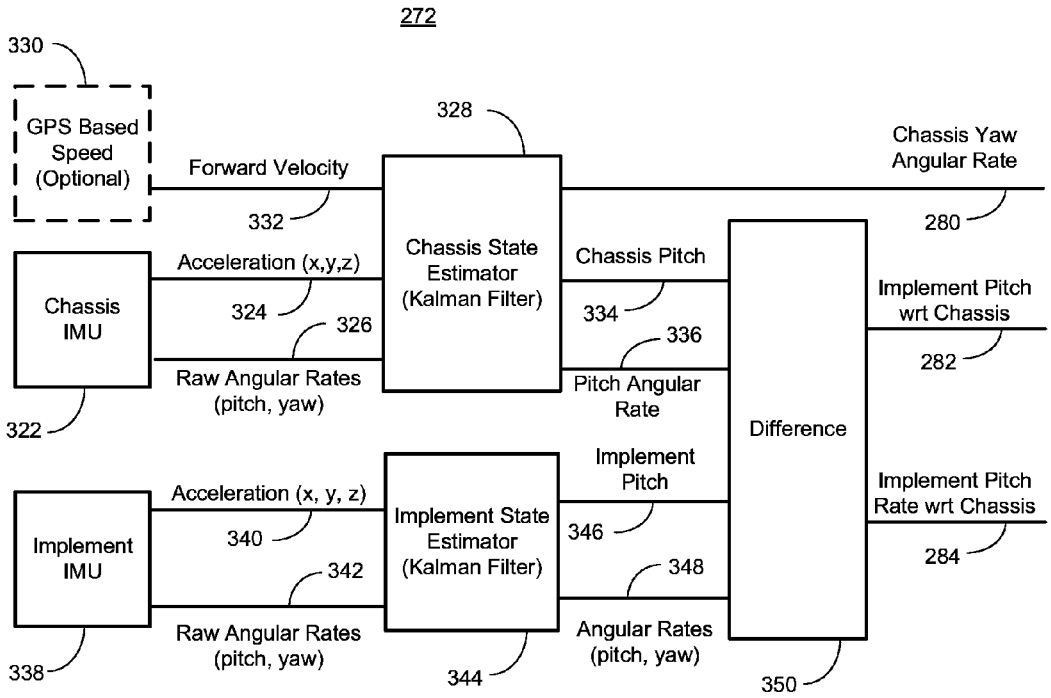
FIG. 8 is another diagram illustrating still another aspect of performing implement position estimation.

The process of estimating implement position is discussed in more detail in FIGS. 6-8. FIG. 6 is a diagram detailing an exemplary process associated with block 252 of FIG. 5. In general, an implement position module 274 receives computed inputs of an implement velocity estimate 278 from a hydraulic estimate module 270 and chassis movement information from an inertial measurement module 272. Additional inputs to the implement position module 274 are a track or a wheel speed 286 and a machine forward velocity 290. Machine steering or slewing commands 288 may also be evaluated. Slewing command data account for speed differences between tracks or wheels in skid-steer machines.

The track or wheel speed 286 may be received from the speed sensor 232 shown in FIG. 3. Similarly, the machine steering or slewing commands 288 may be received via the steering controls 230. Forward velocity may be received from a machine speed sensor 234, which can be a GPS sensor. These direct inputs may be used in conjunction with similar calculated inputs when developing estimated implement position, as discussed more below.

Turning to FIG. 7, the hydraulic estimate module 270 is discussed in more detail. A circuit pressure 300 for a particular cylinder, for example an output of the pressure sensor 222, and a valve solenoid current 302, for example the solenoid current of the hydraulic valve 210, may be used at hydraulic flow estimation module 304 to develop an estimated flow of hydraulic fluid 306 for hydraulic fluid into the hydraulic cylinder 214. In an embodiment, the valve solenoid current 302 is proportional to an aperture size in the hydraulic valve 210. Using this proportional relationship, an estimated aperture size can be developed for a given valve solenoid current 302. Using the estimated aperture size and the circuit pressure 300, the estimated flow of hydraulic fluid 306 can be calculated. Hydraulic cylinder module 308 uses a model of the cylinder, such as bore diameter and piston stroke to determine a relationship between the volume of hydraulic fluid flow to the velocity of the hydraulic cylinder 214.

The mechanics of the implement, e.g., the blade 104, such as length of the arm 106 and an attachment point of the cylinder 107, may be used at linkage kinematics module 312 to develop the implement velocity estimate 278. In the exemplary case of the dozer 101, the relationship from cylinder velocity to implement velocity is relatively simple. In the case of the excavator 150, such an estimate is more complex as the boom 162, the stick 164, and the bucket 166 must all be calculated in sequence to be able to estimate the velocity of the bucket 166. Overall, hydraulic estimation is robust with respect to inertial changes (pitch and yaw) and noise to produce a good velocity estimate. However, hydraulic estimation is also susceptible to position estimation drift over time due to accumulated small errors in the velocity estimate. Hydraulic estimation provides an accurate indication of when the implement is not moving. That is, when stopped, the velocity estimate is good but the position estimate may not be accurate.

The inertial measurement module 272 is discussed in more detail with respect to FIG. 8. Overall, the inertial-based measurements provide good steady state position estimates but noisy or offset velocity measurements. The inertial-based estimation provides an absolute position reference with respect to gravity but is susceptible to inertial-based noises and inertial-based systematic unknowns. These include non-gravity based accelerations and centripetal or tangential accelerations such as non-zero machine pitch and yaw rates. Sensor bias is another source of noise.

A chassis IMU 322, such as any of the one or more chassis IMUs 114 of FIG. 1, provides an acceleration signal 324 in three dimensions, and angular rate signals 326 such as a chassis pitch rate and a chassis yaw rate. The chassis IMU 322 provides chassis position information relative to gravity. An optional GPS system 330 may be used to provide a velocity 332 of the dozer 101. The velocity 332, along with the acceleration signal 324 and the angular rate signals 326, may be provided to a chassis state estimator module 328. The chassis state estimator module 328 may use one or more Kalman filters develop several outputs. One output is a chassis yaw angular rate 280, or the rate of turning left-to-right or right-to-left. Another is a chassis pitch 334 or angle front-to-back. Yet another output of the chassis state estimator is a chassis pitch angular rate 336, or rate of change of pitch. This reading is particularly helpful in determining when a machine such as the dozer 101 may be cresting a hill such that all IMUs on the machine are subjected to a uniform acceleration.

An implement IMU 338, such as the blade IMU 116 of FIG. 1, provides an acceleration 340 signal and an angular rate 342 signal, similar to the chassis IMU 322. An implement state estimator module 344 may also use one or more Kalman filters to develop values for an implement pitch 346 and angular rates for pitch and yaw of the implement 103, such as the blade 104. Note that while yaw in the blade 104 of the dozer 101 is tied to chassis yaw, for other machines such as the excavator 150, the pitch and yaw of the bucket 166 are not necessarily tied to the pitch and yaw of the chassis 152. In an embodiment, the chassis pitch angular rate 336 may also be developed using common readings from all IMUs on the machine, including implement IMUs.

A difference module 350 does a comparison of the chassis pitch 334 and the chassis pitch angular rate 336 with the implement pitch 346 and an implement pitch angular rate 348 to develop an implement pitch 282 relative to the chassis and an implement pitch rate 284 relative to the chassis.

Returning to the implement position module 274 of FIG. 6, an implement position estimate 276 is developed using a Kalman filter to perform successive position estimates by adjusting the weights of the input variables based on their perceived accuracy. For example, pitch rate of the machine may be evaluated to make several adjustments to the weighting. In an embodiment, the IMU data may be de-weighted when chassis pitch rate exceeds a limit because a high pitch rate generally corresponds to more noise in the IMU data. In another embodiment, for similar reasons, a weight of the implement pitch and implement pitch rate may be reduced when the machine (chassis) pitch rate exceeds a threshold. For example, pitch and pitch rate data from the blade IMU 116 may be de-weighted when the one or more chassis IMUs 114 indicate the machine is cresting a hill. A high chassis pitch rate is likely to introduce inertial-based noise into an implement IMU such as the blade IMU 116. Similarly, if the steering controls 230 indicate the machine 100, such as the dozer 101, is turning, data from the blade IMU 116 may be de-weighted.

In another embodiment, when the operator controls 228 indicate the dozer 101 is making a turn, the data from the blade IMU 116 on the blade 104 may be de-weighted. When the operator controls 228, the hydraulic flow estimate, or both, are not active, that is, are in a neutral position, and indicate that an implement is not moving, the linkage velocity weighting may be increased. That is, the confidence in the linkage velocity estimate is high when there is evidence that the linkage velocity is zero.

In some cases, overall non-gravitational acceleration may be considered when adjusting a noise covariance of the Kalman filter. For example, when a combination of pitch and yaw accelerations exceed an acceleration threshold, a noise weighting factor may be increased.

While the above discussion has been directed to a particular type of machine, the techniques described above have application to many other machines.

What is claimed is:

1. A method of positioning an implement of a machine, the method comprising: determining a desired implement position;

developing an estimated implement linkage velocity based on an evaluation of hydraulic fluid flow in a hydraulic circuit coupled to the implement;

determining an estimated implement pitch using an inertial measurement unit (IMU) coupled to the implement;

determining an estimated implement pitch rate using the IMU;

combining the estimated implement linkage velocity, the estimated implement pitch, and the estimated implement pitch rate using a weighted formula to develop an estimated implement position; and moving the implement to the desired implement position based on the estimated implement position.

2. The method of claim 1, wherein developing the estimated implement linkage velocity comprises:

determining an estimated flow of hydraulic fluid to a cylinder coupled to the implement;

calculating a motion of the cylinder using the estimated flow of hydraulic fluid to the cylinder; and calculating the estimated implement linkage velocity using the motion of the cylinder and a model of linkage mechanics.

3. The method of claim 2, wherein determining the estimated flow of hydraulic fluid to the cylinder comprises:

measuring a pressure of a hydraulic fluid in the hydraulic circuit coupled to the cylinder;

analyzing a solenoid current in a hydraulic valve that controls flow in the hydraulic circuit to determine an estimated aperture size of the hydraulic valve; and determining the estimated flow of hydraulic fluid using the pressure of the hydraulic fluid and the estimated aperture size.

4. The method of claim 1, further comprising:

disposing at least one IMU on a chassis of the machine in addition to the IMU coupled to the implement; and determining a pitch and a pitch rate of the chassis of the machine using the at least one IMU.

5. The method of claim 4, wherein combining the estimated implement linkage velocity, the estimated implement pitch, and the estimated implement pitch rate using the weighted formula to develop the estimated implement position further comprises adjusting the weighted formula based on the pitch rate of the chassis of the machine.

6. The method of claim 4, wherein using the weighted formula to develop the estimated implement position further comprises:

reducing a weight of the estimated implement pitch and a weight of the estimated implement pitch rate when the pitch rate of the chassis of the machine exceeds a threshold.

7. The method of claim 1, wherein using the weighted formula to develop the estimated implement position further comprises:

monitoring implement controls for the hydraulic circuit; and increasing a weight of the estimated implement linkage velocity when no control commands are active for the hydraulic circuit.

8. The method of claim 1, wherein using the weighted formula to develop the estimated implement position further comprises:

adjusting a noise weighting factor when non-gravitational acceleration exceeds an acceleration threshold.

9. A system for positioning an implement, the system comprising:

an implement moveably attached to a chassis of a machine;

a hydraulic circuit configured to supply pressurized hydraulic fluid;

a hydraulic cylinder that moves the implement relative to the chassis via hydraulic fluid flow in the hydraulic circuit;

a sensor configured to generate data corresponding to the hydraulic fluid flow in the hydraulic circuit;

an implement inertial measurement unit (IMU) that generates implement position information about a position of the implement relative to gravity;

a chassis IMU that provides chassis position information about a position of the chassis relative to gravity; and a controller configured to control a position of the implement relative to the chassis based on an estimated position of the implement relative to the chassis, the estimated position of the implement relative to the chassis calculated using a weighted combination of the hydraulic fluid flow, implement velocity using the hydraulic fluid flow, the implement position information from the implement IMU, and the chassis position information from the chassis IMU.

10. The system of claim 9, wherein the controller is further configured to repeat calculation of the estimated position of the implement relative to the chassis at an interval and to re-weight the combination of the hydraulic fluid flow, the implement position information, and the chassis position information at each interval based on an updated state of the hydraulic fluid flow, the implement position information, and the chassis position information.

11. The system of claim 9, wherein the controller further uses a machine forward velocity to adjust weighting for the combination of the hydraulic fluid flow, the implement position information, and the chassis position information when calculating the estimated position of the implement.

12. The system of claim 9, wherein the controller increases a noise covariance when a pitch rate of the chassis exceeds a threshold.

13. The system of claim 9, wherein the controller increases a weight for the hydraulic fluid flow based, in part, on a position of an implement control that that moves the implement via the hydraulic circuit when calculating the estimated position of the implement.

14. The system of claim 13, wherein the controller reduces the weight of at least one of the implement position information and the chassis position information based, in part, on an evaluation of non-gravitational acceleration when calculating the estimated position of the implement.

15. The system of claim 14, wherein the evaluation of non-gravitational acceleration includes a chassis yaw rate and a chassis pitch rate.

16. The system of claim 14, wherein the controller uses a Kalman filter to increase the weight for the hydraulic fluid flow based, in part, on the position of the implement control that that moves the implement via the hydraulic circuit when calculating the estimated position of the implement and to reduce the weight of at least one of the implement position information and the chassis position information based, in part, on the evaluation of non-gravitational acceleration when calculating the estimated position of the implement.

17. A method of positioning an implement in a machine, the method comprising:

developing, using a controller using a Kalman filter, an estimated position of the implement based on a previous implement position, an implement pitch, an implement pitch rate, and an estimated implement linkage velocity, wherein the estimated implement velocity is calculated using the hydraulic fluid flow in a hydraulic circuit coupled to the implement; and moving the implement, using the controller, to a desired position based on the estimated position of the implement.

18. The method of claim 17, further comprising increasing a weighting of a noise covariance of the Kalman filter when a pitch rate of the machine exceeds a limit.

19. The method of claim 17, further comprising increasing a weighting of an implement velocity estimate of the Kalman filter when a control associated with moving the implement is in a neutral position.

* * * * *